US005772339A

United States Patent [19]

Yamaguchi

[11] Patent Number: 5,772,339

[45] Date of Patent: Jun. 30, 1998

[54] AUTOMATIC ADJUSTING DEVICE FOR ADJUSTING PLATEN GAP

[75] Inventor: Naoto Yamaguchi, Nagano, Japan

[73] Assignee: Seiko Epson Corporation, Tokyo, Japan

[21] Appl. No.: 867,426

[22] Filed: Jun. 6, 1997

[30] Foreign Application Priority Data

Jun. 6, 1996 [JP] Japan ..... 8-166836
Jan. 8, 1997 [JP] Japan ..... 9-013376

[51] Int. Cl.[6] ..... B41J 11/20

[52] U.S. Cl. ..... 400/55; 400/56; 400/59

[58] Field of Search ..... 400/55, 56, 57, 400/58, 59, 719

[56] References Cited

U.S. PATENT DOCUMENTS

| | | | |
|---|---|---|---|
| 5,051,008 | 9/1991 | Honda et al. | 400/59 |
| 5,074,685 | 12/1991 | Shimizu et al. | 400/56 |
| 5,137,377 | 8/1992 | Ito et al. | 400/56 |
| 5,316,395 | 5/1994 | Imai | 400/56 |
| 5,468,076 | 11/1995 | Hirano et al. | 400/59 |
| 5,474,391 | 12/1995 | Andou et al. | 400/55 |
| 5,474,392 | 12/1995 | Maztsuoka | 400/56 |
| 5,476,328 | 12/1995 | Hori | 400/56 |
| 5,518,324 | 5/1996 | Campbell et al. | 400/56 |

FOREIGN PATENT DOCUMENTS

| | | | |
|---|---|---|---|
| 345079 | 12/1989 | European Pat. Off. | 400/56 |
| 0614763 | 9/1994 | European Pat. Off. . | |
| 0657294 | 6/1995 | European Pat. Off. . | |
| 63-137869 | 6/1988 | Japan | 400/56 |
| 4-14634 | 3/1992 | Japan . | |
| 5-201095 | 8/1993 | Japan | 400/56 |
| 7-156503 | 6/1995 | Japan . | |
| 2269137 | 2/1994 | United Kingdom . | |

*Primary Examiner*—Christopher A. Bennett
*Attorney, Agent, or Firm*—Sughrue, Mion, Zinn, Macpeak & Seas, PLLC

[57] ABSTRACT

An automatic adjusting device for accurately adjusting a platen gap including an encoder 14 for outputting pulse signals in accordance with a moving distance of a carriage, a pulse width detector for detecting a pulse width of the pulse signal when the carriage is moved from a reference position in a direction of the platen, a difference calculator for calculating a difference between a pulse width of the pulse signal sent from the pulse width detector and a pulse width of a stored pulse signal, a contact detector for judging a contact position of the recording head with the platen surface by comparing the difference with the reference value, and a controller for controlling a platen gap in accordance with the thickness of a recording medium charged on the platen detected by a pulse signal sent from the encoder and a signal sent from the contact detector. A change in the pulse width caused by resistance on the carriage is subtracted by the difference detector to obtain correction data so that the contact point can be accurately detected.

25 Claims, 13 Drawing Sheets

AUTOMATIC ADJUSTING DEVICE FOR ADJUSTING PLATEN GAP

The present invention relates to a technique for automatically adjusting a gap between the platen and the printing head in a printer in accordance with the thickness of a recording medium. More particularly, the present invention relates to a technique for judging the thickness of a recording medium charged on the platen and adjusting a gap between the platen and the printing head to an appropriate distance.

BACKGROUND OF THE INVENTION

In a recording head, especially in a wire-dot type recording head by which printing is conducted when a recording medium is struck by a wire via an ink ribbon, it is necessary to minimize a striking stroke of the wire in order to accomplish high speed printing.

Mechanical strength of the wire-dot type recording head is high, and further it is possible to perform copy-printing when copy sheets are used in the process of printing. Therefore, a large number of types of recording mediums are used in the case of the wire-dot type recording head. For this reason, the distance from the dot formation surface of the recording head to the recording medium is greatly changed as compared with other types of printers.

Accordingly, in a printer into which the wire dot-type recording head is incorporated, there is provided a mechanism for adjusting a relative gap between the platen and the recording head. However, much skill and labor are required to adjust the gap to be the most appropriate value in accordance with the thickness of a recording medium. Therefore, it is difficult and time consuming to set the appropriate gap.

In order to solve the above problem, for example, Japanese Examined Patent Publication No. 4-14634 discloses a printer in which the relative positions of the platen and the carriage are automatically changed; that is, the platen gap is automatically adjusted, which will be described below. The printer in the above-noted publication comprises: a step motor for moving a carriage in a direction perpendicular to a platen; an encoder for generating a pulse signal in accordance with the movement of the carriage; and a control section for processing a feedback pulse signal sent from the encoder. When the recording head is moved onto the platen side, it comes into contact with a recording medium, so that the step motor enters and out-of-step condition. The out-of-step condition of the step motor is detected by a change in the encoder signal. Therefore, according to a distance of movement of the carriage from a reference position to a position at which the step motor enters the out-of-step condition, the thickness of the recording medium is determined. According to the determined thickness, the relative positions of the platen and the carriage are automatically adjusted, that is, the platen gap is automatically adjusted.

According to the above apparatus, it is possible to automatically adjust the platen gap in accordance with the recording head. However, the recording head is pressed against the recording medium by an unnecessarily strong force. Accordingly, the recording head is damaged and the recording medium is soiled.

In order to solve the above problem, Japanese Unexamined Patent Publication No. 7-156503 discloses a platen gap adjusting device comprising: a step motor for moving a carriage in a direction perpendicular to a platen surface; moving distance detecting means for outputting pulse signals, the number of which is proportional to a distance of movement of the carriage in the direction perpendicular to a platen shaft; and a contact judging means for detecting contact of the recording head with the platen surface by a change in the width of the pulse signal sent from the moving distance detecting means when the carriage is moved from a reference position toward the platen.

According to the above platen gap adjusting device, the thickness of the recording medium can be accurately measured only when the carriage comes into pressure contact with the recording medium by a necessary minimum force. Therefore, it is possible to prevent the recording head from being damaged and to prevent the recording medium from being soiled. However, since the recording head contacts the recording medium placed on the platen surface with necessary minimum pressure, when a load given to the carriage is changed by the influence of paper powder accumulating in the guide member over a long period of time, the judgment of contact of the recording head with the recording medium cannot be conducted accurately.

SUMMARY OF THE INVENTION

The present invention has been designed to solve the above problems.

It is an object of the present invention to provide an automatic adjusting device for adjusting a platen gap by which the carriage is made to come into contact with the recording medium by a necessary minimum force where erroneous determinations of the contact position, caused by the fluctuation of a load given to the carriage in the direction of the platen, is minimized to prevent damage to the recording head and soiling of the recording medium.

In order to solve the above problems, the present invention provides an automatic adjusting device for adjusting a platen gap comprising: a step motor for moving a carriage, on which a recording head is mounted, in a direction perpendicular to a platen surface; a moving distance detecting device for outputting pulse signals of a constant pulse width, the number of which coincides with a moving distance of the carriage; a pulse width detecting device for detecting a pulse width of the pulse signal when the carriage is moved from a reference position in a direction of the platen; a storing device for storing reference data of the pulse width of the pulse signal corresponding to a position of the platen when the carriage is moved under the condition that the platen is not charged with a recording medium; a difference calculating device for calculating a difference between a pulse width of the pulse signal sent from the pulse width detecting device when the carriage is moved under the condition that the platen is charged with a recording medium, and a pulse width of the pulse signal stored in the storing device when the platen is located at a subject position; a contact judging device for judging a contact position of the recording head with the platen surface in accordance with a change in the difference; and a control device for controlling a relative gap between the carriage and the platen by a step motor so that the relative gap can be made to correspond to a thickness of the recording medium when the thickness of the recording medium is detected by a pulse signal of the pulse width detecting device in accordance with a distance from the reference position to the contact position judged by the contact judging device.

Resistance of the carriage given in the direction of the platen is detected as a change in the width of the pulse signal of the moving distance detecting device, and a distance corresponding to this change in the width of the pulse signal is subtracted when the platen gap is adjusted, so that only a change in the pulse width of the moving distance detecting device is detected.

BRIEF DESCRIPTION OF THE DRAWINGS

FIG. 12(*b*) is a graph showing a change in the pulse width of the pulse signal corresponding to one revolution of the step motor, output from the encoder, wherein only a component caused by the encoder is shown in FIG. 12(*b*);

FIG. 12(*c*) is a graph showing a change caused by a reciprocal action;

DETAILED DESCRIPTION OF THE PREFERRED EMBODIMENTS

Referring to an example shown in the attached drawings, the present invention will be explained below in detail.

Figure 1:
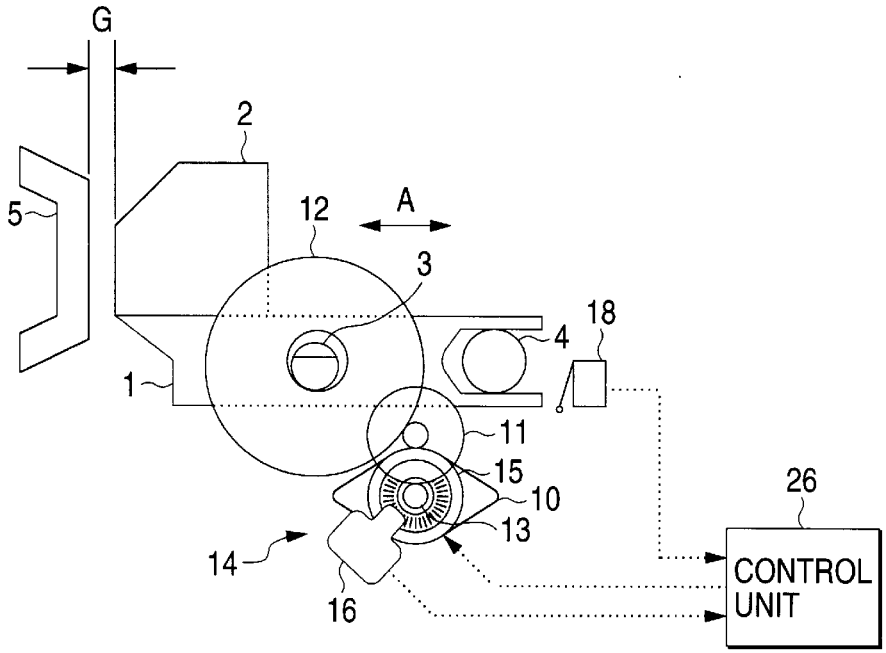
FIG. 1 illustrates an example of the carriage drive mechanism of the present invention.
Figure 2:
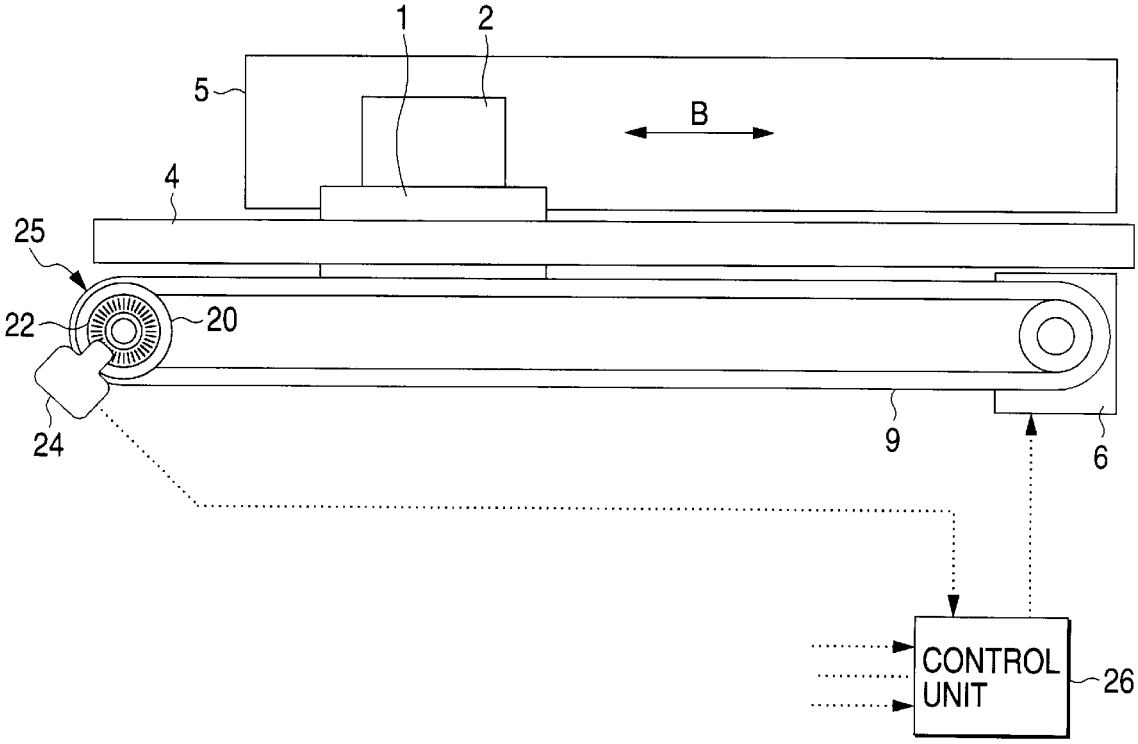
FIG. 2 illustrates an example of the serial printer of the present invention.

FIG. 1 illustrates a mechanism for adjusting a relative gap between the platen and the recording head of the serial printer to which the present invention is applied. FIG. 2 illustrates the structure of the printer with respect to the axial direction of the platen. In the drawings, reference numeral 1 is a carriage into which the impact wire type recording head 2 is incorporated. The carriage 1 is mounted on a guide shaft 3 and a stationary guide shaft 4, wherein the guide shaft 3 is rotatably attached to the base in an eccentric condition. The carriage 1 can be moved in the direction of arrow A in the drawing. Relative gap G between the recording head 2 and the platen 5 can be arbitrarily adjusted in accordance with the rotation of the guide shaft 3.

The carriage 1 is connected to a carriage motor 6, which is a direct current motor in this example, via a timing belt 9. Therefore, the carriage 1 can be reciprocated in the axial direction of the platen shaft shown by arrow B in the drawing while the gap G, adjusted by the guide shaft 3, is maintained at a predetermined value.

Figure 4:
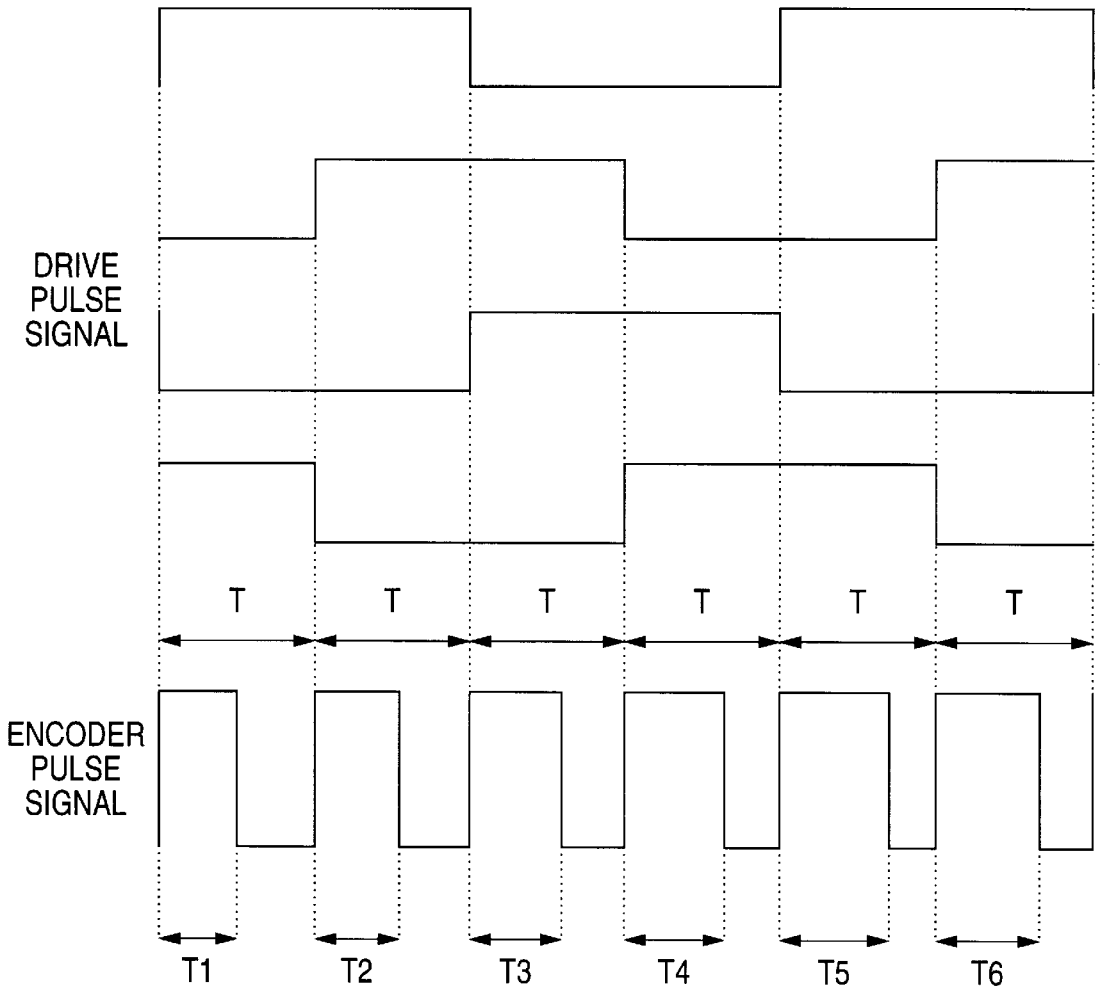
FIG. 4 illustrates the relationship between the drive signal to drive the step motor and the signal sent from the encoder in the above apparatus.
Figure 5:
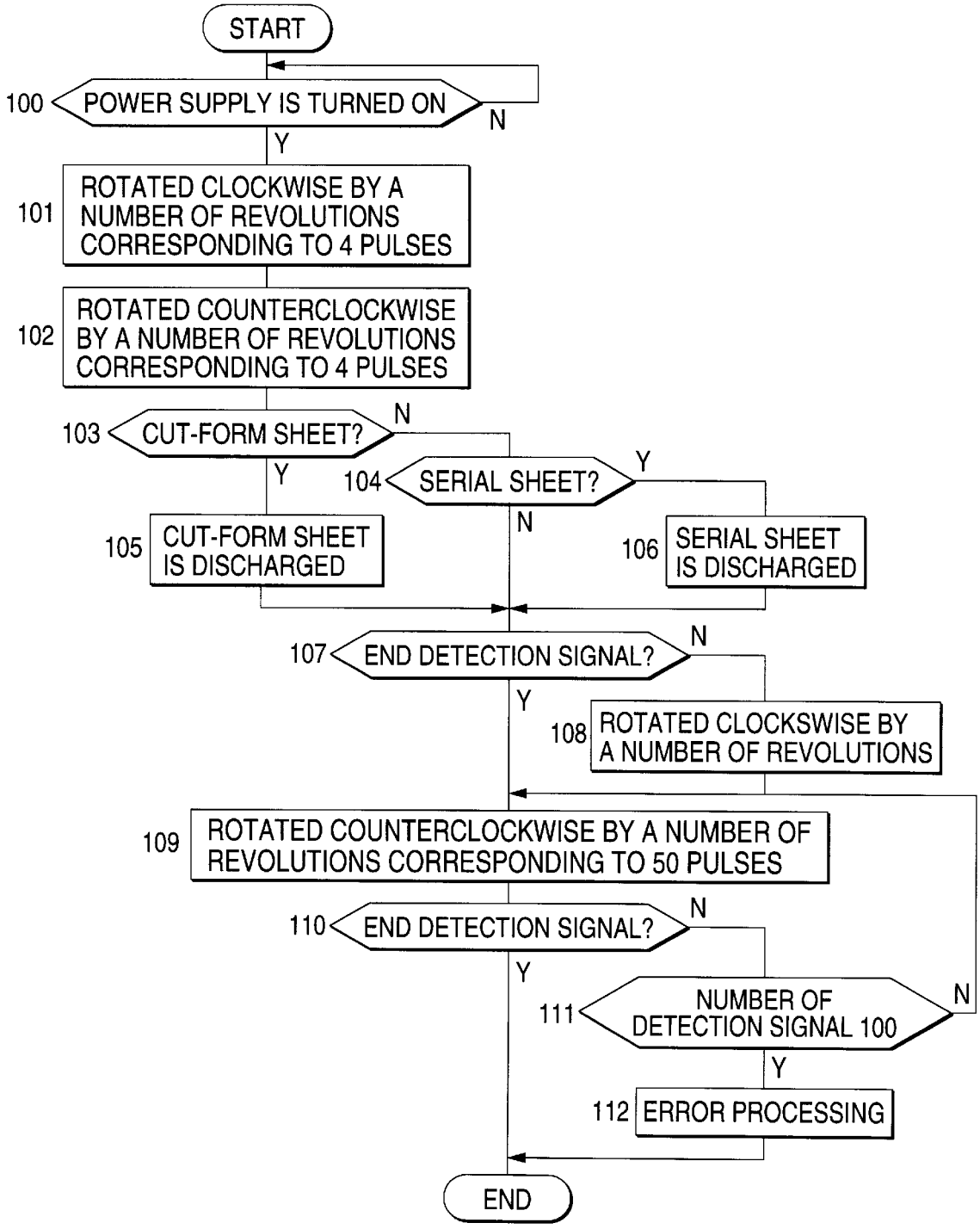
FIG. 5 is a flow chart showing an initializing operation conducted in the above apparatus.

Reference numeral 10 is a step motor for rotating the guide shaft 3. In this example, there is used a step motor of 48 poles excited by means of 2—2 phase. For example, the step motor 10 is driven by the drive pulse signals output at a period of 3.5 ms when running at a constant speed. This step motor 10 is connected with a gear 12 mounted on the guide shaft 3, via a reduction gear 11. A code disk 15 of a first encoder 14 is attached to a shaft 13 of the step motor 10. The code disk 15 of the first encoder 14 is used for outputting pulse signals of a constant width, the number of which is proportional to the rotational angle. As illustrated in FIG. 4, the code pattern of the code disk 15 is determined so that a signal of one pulse width can be output from a code detector 16 in synchronization with the drive of one phase of the step motor 10.

Reference numeral 18 is an end position detector. The end position detector is positioned so that a signal can be output from the detector when the carriage 1 is withdrawn to the home position, that is, when the carriage 1 is withdrawn to a reference position. In this example, a micro-switch is used as the end position detector.

A code disk 22 is fixed to a member for driving the carriage in the primary scanning direction. In this example, an idle roller 20 for the timing belt 9 is used as the member to which the code disk 22 is fixed. There is provided a second encoder 25 that includes a code detector 24 for detecting the code disk 22.

Reference numeral 26 is a control unit that receives signals sent from the encoder 14 and the end position detector 18 and controls the step motor 10 in accordance with a flow chart described later.

Figure 3:
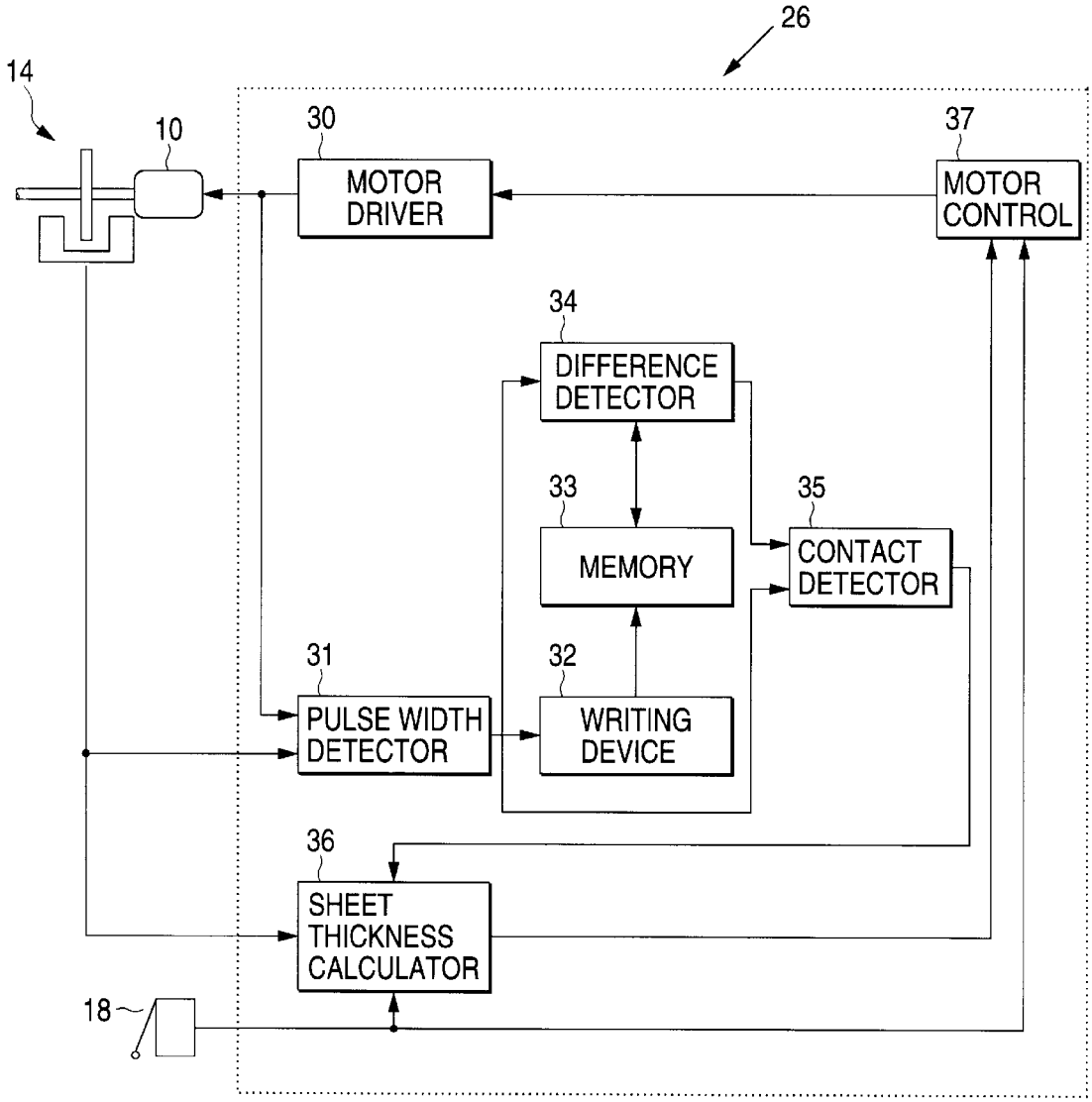
FIG. 3 illustrates an arrangement of a control unit according to the present invention.

FIG. 3 illustrates an example of the control unit 26 described above. Reference numeral 30 is a motor driver for driving the step motor 10 so that the carriage 1 can be moved in the direction perpendicular to the surface of the platen 5. Reference numeral 31 is a pulse width detector. This pulse width detector 31 is operated as follows. Pulse width $T_1$, $T_2$, $T_3$, ●●●, $T_i$ (shown in FIG. 4) of a pulse signal, which is output from the encoder 14 each time the step motor 10 conducts driving with respect to one phase, is detected. An average of a predetermined number of signals, for example, an average of four signals is found. Time T0 of a predetermined number of pulse signals sent from the encoder 14 in the case of normal driving, that is, in the case of driving without being affected by a load, is also determined. Then, a difference tn between the above average of a predetermined number of signals and the time T0 is output.

Reference numeral 32 is a writing device. The writing device 32 is operated as follows. The relative coordinate with respect to the reference position of the carriage 1 is detected from the number of pulse signals sent from the encoder 14, and the signal tn of the pulse width detector 31 at a predetermined position is stored in a memory 33. Reference numeral 34 is a difference detector. The difference detector 34 is operated as follows. The relative coordinate with respect to the reference position of the carriage 1 is detected from the signal sent from the encoder 14. A difference, between the pulse width tn stored in the memory 33 and the signal $t_n$, output from the pulse width detector 31 in accordance with the pulse signal sent from the encoder 14, is calculated.

Reference numeral 35 is a contact detector. The contact detector 35 is operated as follows. A point of time at which the time width of the signal $t_n$, sent from the difference detector 34 exceeds a predetermined time TP is judged to be a contact point, and a signal is output to the sheet thickness calculator 36 described later.

Reference numeral 36 is a sheet thickness calculator. The sheet thickness calculator 36 starts counting pulse signals sent from the encoder 14 in accordance with a signal sent from the end position detecting device 18. The sheet thickness calculator 36 stops counting pulse signals in accordance with a signal sent from the contact detector 35. According to the number of the counted pulse signals, the thickness of a recording medium is calculated.

Reference numeral 37 is a motor control. The motor control 37 controls the step motor 10 for adjusting a platen gap. When a loading switch (not shown) of the recording medium is pressed down, the carriage 1 is moved in a direction so that the carriage 1 can be separated from the platen 5, that is, the carriage is withdrawn until a signal is output from the position detector 18, so that the carriage is set at the reference position. After that, the carriage 1 is moved in the direction of the platen, and the step motor 10 is driven so that the carriage 1 can be withdrawn to a position at which the most appropriate gap can be formed with respect to the recording medium detecting the thickness of the recording medium.

Referring to the flow charts shown in FIGS. 5 to 8, operation of the apparatus composed as described above will be explained below.

Initializing

An electric power switch (not shown) of the printer is turned on in step 100. Then, in step 101 the motor control 37 rotates the step motor 10 clockwise (CW) by a predetermined number of revolutions, for example, by a number of revolutions corresponding to four pulses, so that the carriage 1 is made to advance by a minute distance in the direction of the carriage. In steps 102, the step motor 10 is rotated counterclockwise (CCW) by a predetermined number of revolutions, for example, by the number of revolutions corresponding to four pulses, so that the carriage 1 is withdrawn to the initial position. In this way, back lash of the reduction gear 11 is removed.

Next, it is detected whether a cut-form sheet or a serial sheet is charged on the platen in steps 103 and 104. In the case where a sheet is charged on the platen, it is discharged in steps 105 and 106, and then it is detected whether a signal has been sent from the end position detecting device 18, that is, it is detected whether or not the carriage 1 has been withdrawn to the reference position in step 107. In the case where the carriage 1 is not set at the reference position, the step motor 10 is rotated clockwise by the number of revolutions corresponding to 50 pulses in steps 108.

The step motor 10 is rotated counterclockwise (CCW) in step 109 by the number of revolutions corresponding to 50 pulses, so that the carriage 1 is moved, and it is confirmed whether or not a signal has been sent from the end position detecting device 18 in step 110. In this connection, when a signal is not output from the end position detecting device 18 even after the above operation has been conducted by an amount corresponding to 100 pulses at step 111, error processing is conducted in steps 112.

Positioning of the Reference Position

Figure 6:
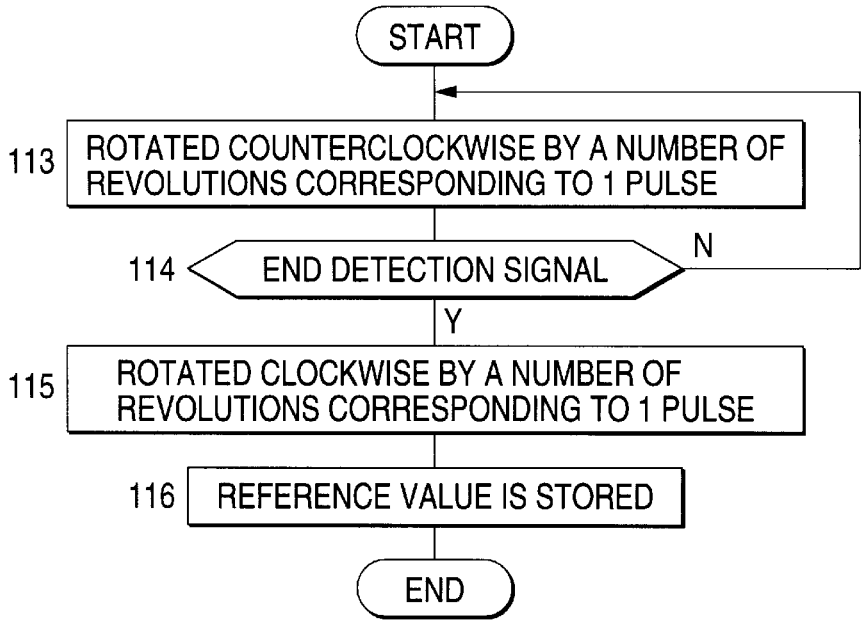
FIG. 6 is a flow chart showing a home position detecting operation conducted in the above apparatus.

Under the condition that the carriage 1 comes into contact with the end position detecting device 18 after the completion of initialization, the step motor 10 is rotated counterclockwise (CCW) by every pulse in step 113 in FIG. 6. When a signal is output from the end position detecting device 18 by the above operation in step 114, the step motor 10 is rotated clockwise (CW) by the number of revolutions corresponding to one pulse in step 115, and a reference value, for example, 550 is accommodated in the sheet thickness calculator 36, so that a coordinate value to be used as a reference position, is accommodated in step 116.

Passage Error Detecting

After the reference position has been determined, drive pulse signals are output to the step motor 10, so that the carriage 1 is made to advance toward the platen 5. Each time one pulse signal is output from the encoder 14 in accordance with the movement of the carriage 1, the reference value (550) accommodated in the sheet thickness calculator 36 is decreased in accordance with the pulse signal sent from the encoder 14 in step 117 in FIG. 7. Further, each time one pulse signal is output from the encoder 14, its pulse width $T_i$ is detected in step 118.

When signals, the number of which is a predetermined value N, for example, four signals, are continuously output from the encoder 14 in step 119, the pulse width detector 31 calculates the average $(T_{i-3}+T_{i-2}+T_{i-1}+T_i)/4$ of the above values, and the reference value T0 is subtracted and the result is output as a delay time $t_n$ in step 120. The writing device 32 stores the delay time $t_n$ in the memory 33 in accordance with the present relative position with respect to the reference position of the carriage 1 detected by the encoder 14 in step 120.

The above steps 118 to 120 are repeated as follows in step 121. Due to the foregoing, as shown by reference character A in FIG. 9, a change in the pulse width of the pulse signal sent from the encoder 14 at each position from the reference position to the platen 5, that is, the delay time $t_1$, $t_2$, ●●●, $t_n$, is stored in the memory 33.

On the other hand, in step 122 each time the delay time tn is output from the pulse width detector 31, the contact detector 35 calculates the difference $\Delta t=t_n-t_{n-1}$ between the delay time $t_n$ and $t_{n-1}$ immediately before the delay time $t_n$. As described above, when a fore end of the recording head 2 comes into contact with the platen 5, although the drive pulse signals are fed to the step motor 10, the carriage is almost stopped, and the difference Δt exceeds the reference value $T_p$ as determined in step 123. Therefore, a signal is output from the contact detector 35. Accordingly, the motor control 30 withdraws the carriage 1 onto the home position side.

Platen Gap Adjusting

After a sheet of paper has been fed by the operation of a loading switch (not shown) and others in step 124, the carriage 1 is subjected to movement control and moved into a printing region, and the aforementioned reference position determination processing is conducted.

A drive pulse signal is output to the step motor 10, so that the carriage 1 is moved toward the platen 5. The sheet thickness calculator 36 decreases the number 550, which has been previously accommodated, in accordance with the pulse signal sent from the encoder 14 in step 125. Each time one pulse signal is output from the encoder 14 in accordance with the movement of the carriage 1, its pulse width $T_i$, is detected in step 126. When signals, the number of which is a predetermined value N, for example, four signals are continuously output from the encoder 14 in step 127, the average $(T_{i-3}+T_{i-2}+T_{i-1}+T_i)/4$ of the above values is calculated, and the reference value T0 of the pulse width is subtracted from the above average. The difference detector 34 subtracts the delay time tn at this position stored in the memory 33. Therefore, in step 128 the difference detector 34 calculates the delay time tn' from which an amount of time corresponding to fluctuation of the load caused by the friction in the movement passage from the carriage 1 to the platen is removed.

As described above, using the delay time tn previously accommodated in the initializing process of the memory 33, a pulse signal of the encoder 14 in the contact detecting process is subjected to subtraction processing. Due to the foregoing, an amount of time corresponding to the delay of time (hatched portion in the drawing) caused by the friction in the process of moving can be removed from the signal $t_n$ of the pulse width detector means 31 shown by reference character A in FIG. 9. Accordingly, as shown by reference character B, it is possible to obtain the delay time $t_{n'}$ from which an error caused by the fluctuation of the load in the moving passage of the carriage 1 is removed.

Each time the new delay time $t_n$, is detected in step 129 as described above, the contact detector 35 calculates the difference $\Delta t = t_{n'} - t_{n-1'}$ between $t_{n'}$ and $t_{n-1'}$ which is the delay time immediately before $t_{n'}$ in step 130. When the recording head 2 comes into contact with a recording medium charged on the platen 5, the pulse width of the pulse signal sent from the encoder 14 is extended. Therefore, the difference Δt' detected by the difference detector 34 exceeds reference value Tp used for judging the contact of the recording head 2 with the platen 5 in step 131. Accordingly, a signal is output from the contact detector 35.

Figure 9:
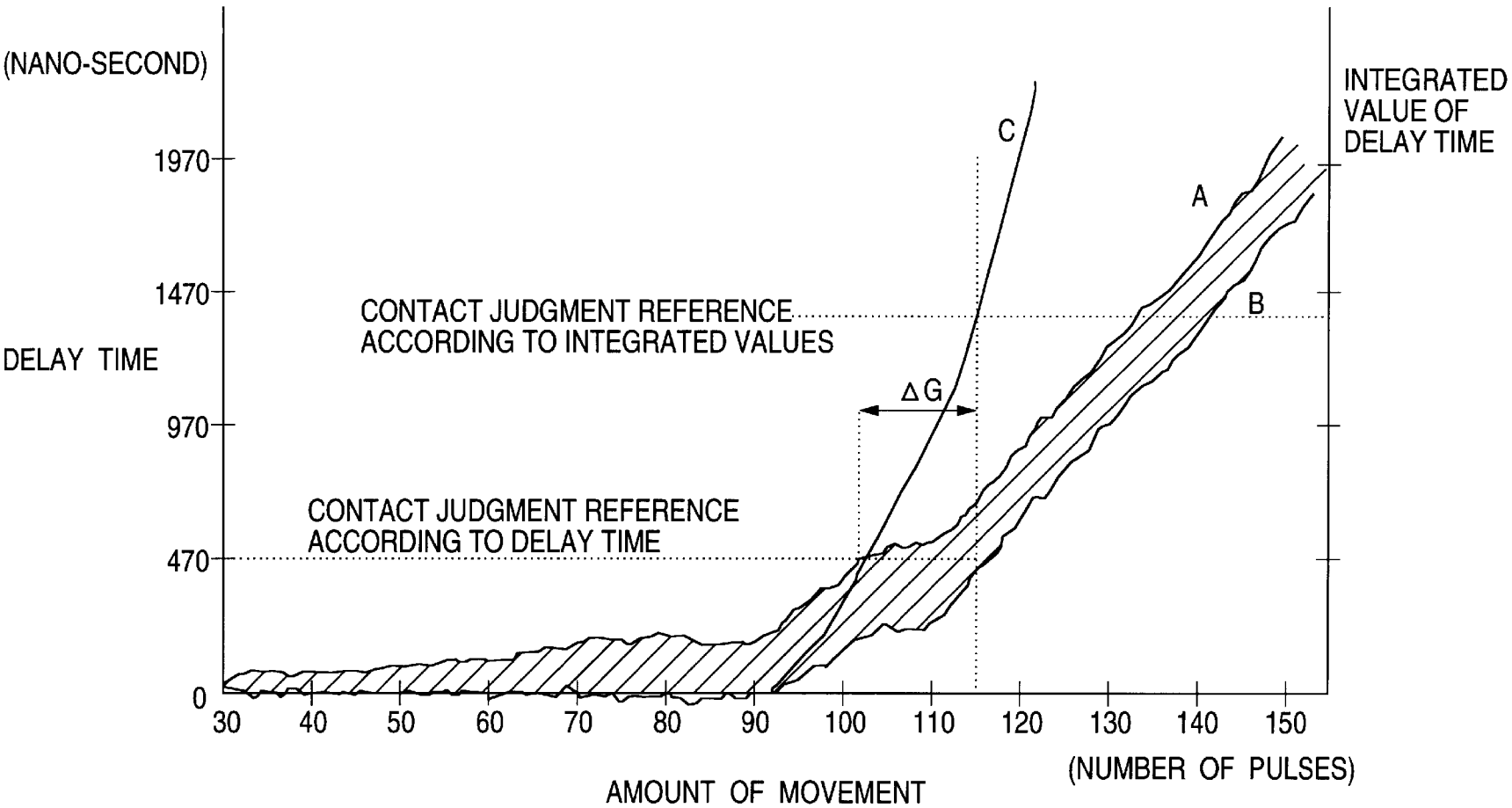
FIG. 9 is a diagram showing a time delay detected by the platen surface recognizing processing and the platen gap adjusting processing while the time delay is made to correspond to a position of the carriage.

In step 132, the sheet thickness calculator 36 calculates the sheet thickness by a difference between the counted value at this time and the reference value (550) stored as a reference position. Due to the foregoing, as shown in FIG. 9, when a pulse signal sent from the encoder 14 is extended longer than the reference time by a predetermined value, in this example, when a pulse signal sent from the encoder 14 is extended longer than the reference time by 470 nanoseconds, it is judged that the recording head has come to the contact position. Accordingly, even if paper powder adheres to the carriage 1 and the fluctuation of the load is temporarily caused, it is possible to judge the contact position such that detection error ΔG is eliminated from the judgment.

At this point of time, the step motor 10 has not been put into an out-of-step condition. Therefore, the recording medium is not subjected to high pressure. For this reason, there is no possibility that the recording medium is soiled or the recording head is damaged.

After the contact position has been detected, the motor control 37 drives the step motor 10, so that the carriage 1 is withdrawn from the platen 5 to a predetermined position. Then, the carriage 1 is moved to the platen side in accordance with the calculated thickness of the recording medium so that the most appropriate platen gap can be obtained, and the carriage 1 is prevented from moving toward the platen in step 133.

When a printing operation is initiated under the above condition, while the platen gap that has been set before is being maintained, the carriage 1 is reciprocated in the axial direction of the platen by the carriage driving motor, and the recording head is given a printing signal, so that a wire, which is a dot forming element, is stricken onto the recording medium through an ink ribbon not shown. In this way, the printing operation is carried out. When the recording medium is changed, the most appropriate platen gap for the recording medium is set through the above setting process.

Figure 10:
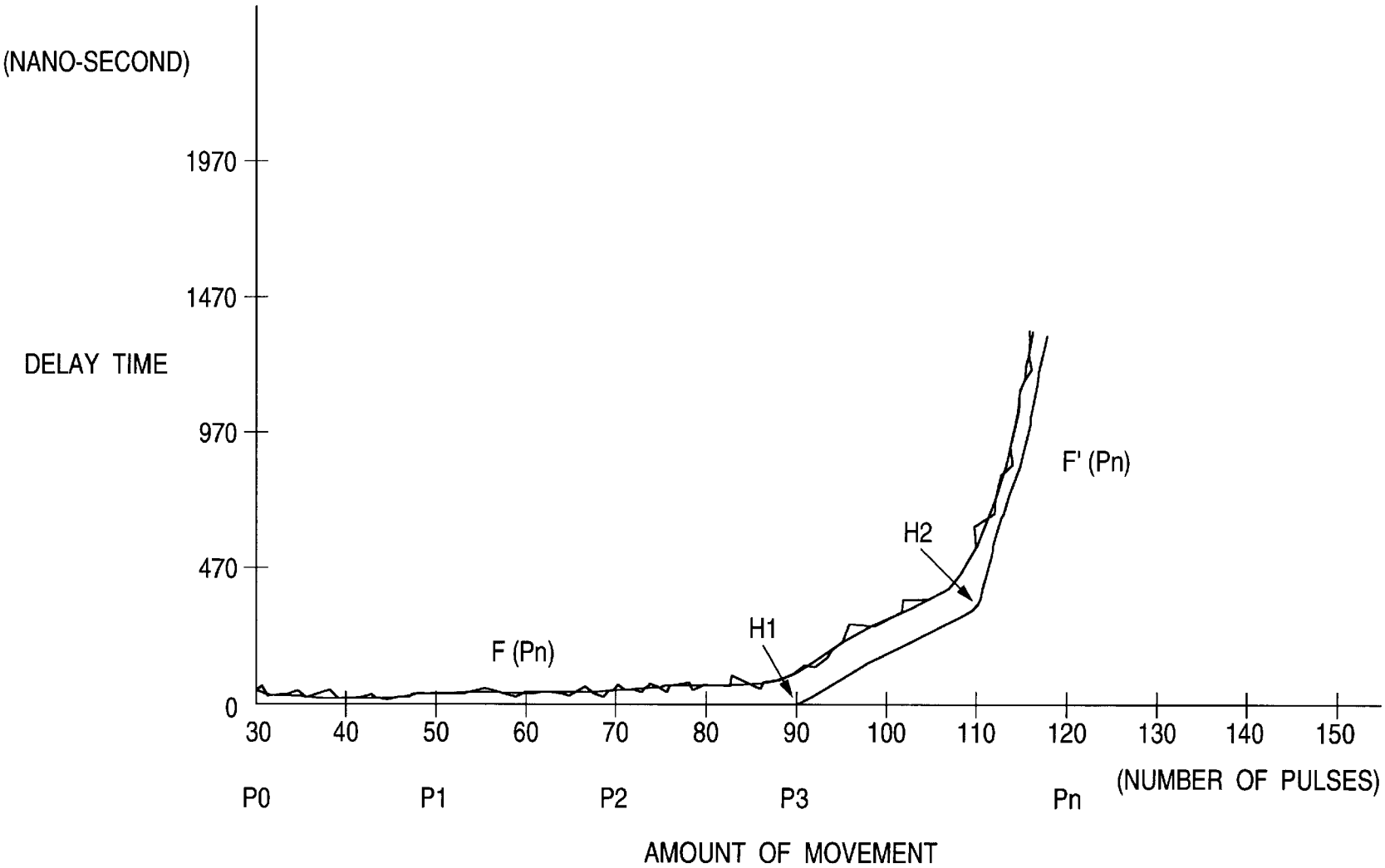
FIG. 10 illustrates another example of the present invention.

In this connection, in the above example, data of time delay from the reference position to a position close to the platen 5 is successively stored in the memory. However, it is possible to provide the same effect as described above when the operation is conducted as follows. Time delay $t_{p1}$, $t_{p2}$, $t_{p3}$ ●●●} $t_{pn}$ at points P1, P2, P3 ●●●, Pn, the relative positions with respect to the reference position of which are clear as illustrated in FIG. 10, is measured. According to the relative position $P_n$ and the delay time $t_{pn}$ concerned, a function $t_p$=F(Pn) to express time delay of the carriage 1 in the direction of the platen is found. In the process of adjusting a platen gap, delay time at each position is generated by this function F(Pn) so as to conduct correcting.

Figure 11:
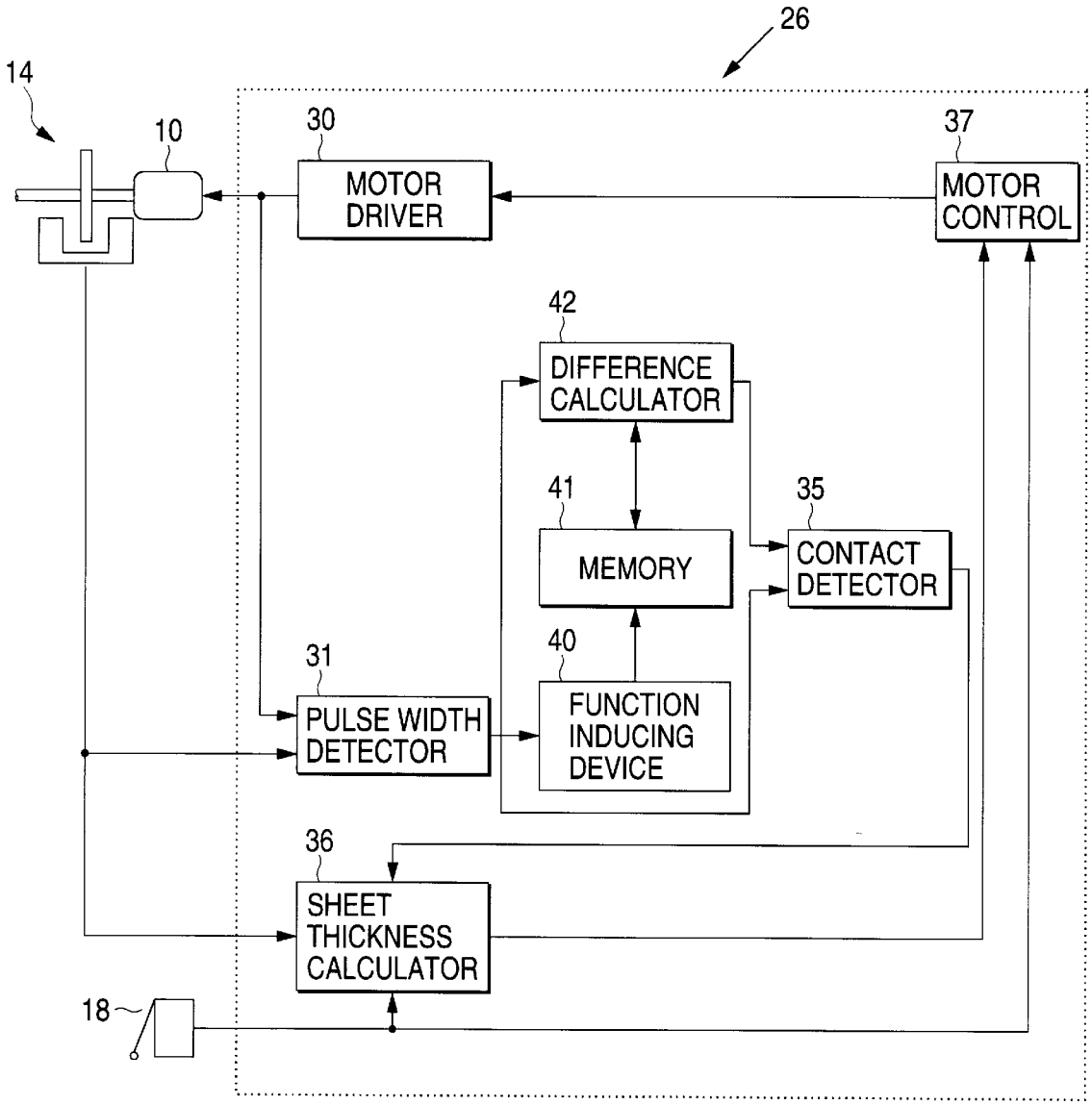
FIG. 11 illustrates still another example of the present invention.

FIG. 11 illustrates the above example. In FIG. 11, reference numeral 40 is a function inducing device. This function inducing device 40 is operated as follows. Delay time at a plurality of points $t_{p1}$, $t_{p2}$, $t_{p3}$ ●●●$t_{pn}$, the relative positions with respect to the reference position of which are clear, is received from the pulse width detector 31, and the function F(Pn) to express time delay of the carriage 1 in the direction of the platen is induced. The thus induced function is written in the memory 41. Reference numeral 42 is a difference calculator. A difference between the delay time $t_{n'}$ sent from the pulse width detector 31 and correction time $t_n$ at the present position found by the function F(Pn) stored in the memory 41 is calculated and output to the contact detector 35.

According to the above arrangement, with respect to the pulse width of the encoder 14 detected by the pulse width detector 31 in the process of adjusting a platen gap, an amount of pulse width corresponding to the friction in the moving passage can be accurately offset in accordance with the function F(Pn) stored in the memory 41, the amount of data of which is small. Therefore, compared with the above example in which data at each point is successively stored, it is possible to decrease an amount of data to be stored in the memory 41. Accordingly, it is possible to use memory having a small capacity.

A gradient of the function F(Pn) to express an amount of load is greatly changed in accordance with a state in which the recording head is running without being given any load, a state in which the recording head comes into contact with the recording medium and starts moving while it resists an elasticity of the recording medium, and a state in which the recording medium is compressed to a limit by the recording head so that the mechanism such as the platen is elastically deformed. That is, until the recording head moves from the reference position and comes into contact with the platen, the load given to the recording head is given by a frictional force between the recording head and the guide member. Therefore, the gradient is substantially flat. At the beginning of contact of the recording head with the recording medium, a load given to the recording head is determined by the elasticity of the recording medium. Accordingly, the gradient is substantially linearly increased in accordance with a modulus of elasticity of the recording medium. When the recording head is further moved and the compression reaches a limit, a load is given to the recording head so as to elastically deform the mechanism such as the platen.

Accordingly, when the platen gap is adjusted, the same method may be adopted. Delay time $t_{p1}$, $t_{p2}$, $t_{p3}$, ●●●, $t_{pn}$ at a plurality of points P1, P2, P3, ●●●}, Pn with respect to the reference position is corrected by the function F(Pn), and the function F'(Pn) is found by the same method. When the function F(Pn) is differentiated, it is possible to obtain relatively large two points of inflection H1 and H2 as illustrated in FIG. 10. Consequently, it is possible to judge a state of the recording head according to the points of inflection. That is, it is possible to determine whether a) the recording head is running without any load, b) the recording head comes into contact with the recording medium and compresses only the recording medium, or c) the recording head has compressed the recording medium to a limit and starts conducting elastic deformation of the mechanism. Even if the point of inflection H2 at which the recording medium is compressed to a limit is determined to be a contact point, a high pressure resulting in an out-of-step condition of the step motor is not applied to the recording medium. Accordingly, it is possible to detect the contact point without soiling the recording medium or damaging the recording head.

In this connection, in the above example, a point of time at which the recording head comes into contact with the recording medium is detected by directly comparing the reference value Tp with a difference $\Delta t=t_{n'}-t_{n-1'}$ of the delay time $t_{n'}$ between a state in which the recording medium is not charged and a state in which the recording medium is charged. However, judgment of the contact position may be conducted as follows. As illustrated in FIG. 9, a difference $\Delta t=t_{n'}-t_{n'-1}$ at each point is integrated by the contact detector 35, and a point of time at which the integrated value C is not less than the reference value is judged to be a contact point. Even if dust adheres into the passage after the detection of the passage error processing, illustrated in FIG. 7, and the moving resistance given to the carriage suddenly fluctuates when the carriage moves in the passage, this fluctuation can be absorbed by averaging the resistance. Therefore, the error of judging the contact position can be reduced to a minimum.

In this connection, the step motor 10 has a stator and a rotor, the numbers of poles of which are usually the same. For example, the stator is provided with 48 salient poles and the rotor is provided with 48 poles, and when a predetermined number of drive pulses are fed to the stator, the rotor is rotated by an amount of rotations corresponding to the number of poles which coincides with the number of drive pulses, without conducting feedback control, and the rotation is stopped at a stabilizing point of each pole. However, due to the fluctuation of the stabilizing point of each pole and also due to the eccentricity of the rotor with respect to the rotational shaft, the rotational speed of the rotor fluctuates periodically, and further, the dimensional accuracy of slits and code elements formed on the code disk is not necessarily high.

Figure 12:
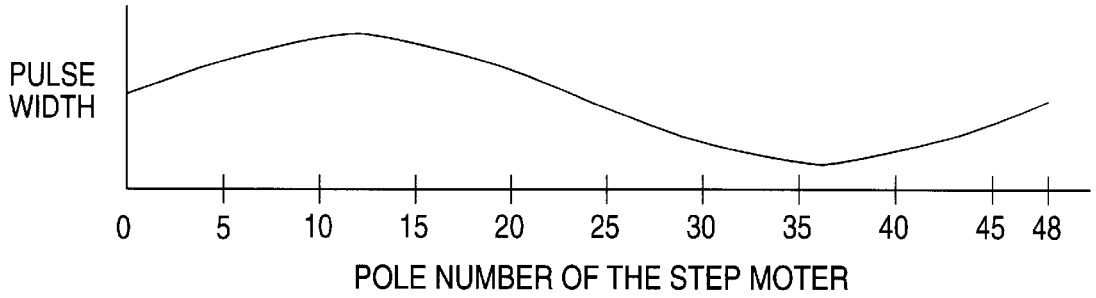
FIG. 12(*a*) is a graph showing a change in the pulse width of the pulse signal corresponding to one revolution of the step motor, output from the encoder, wherein only a component caused by the step motor is shown in FIG. 12(*a*)
Figure 12:
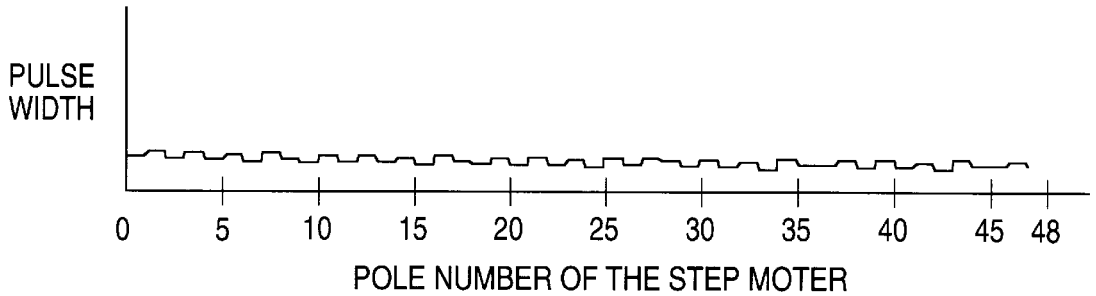
Figure 12:
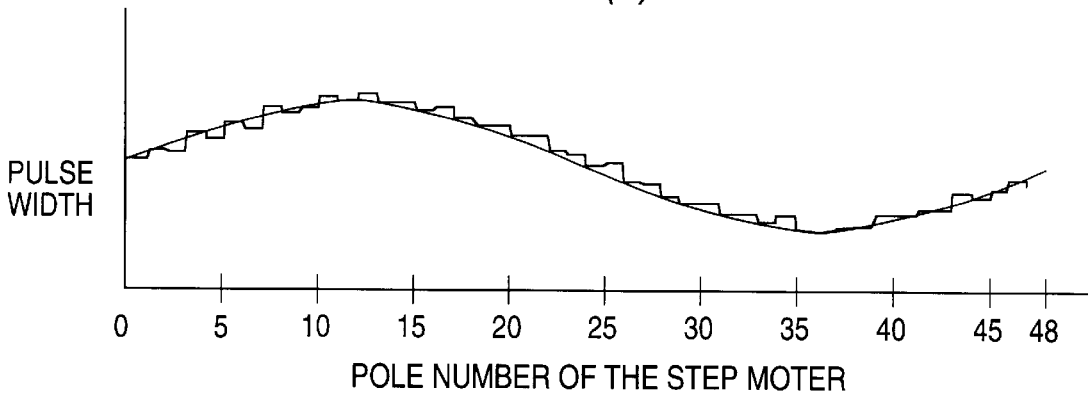

Therefore, even if the step motor 10 is rotated at a constant speed without being given an external force, when each pole of the rotor is moved to each pole of the stator, in the width of the pulse signal output from the encoder 14, a sine-curve-shaped surge caused by the speed fluctuation of the step motor 10 illustrated in FIG. 12(*a*) and a time error caused by the fluctuation of the size of the code element of the encoder illustrated in FIG. 12(*b*) are superimposed on each other. In this way, a signal illustrated in FIG. 12(*c*) is composed. Accordingly, there is a possibility that an error is caused when the contact position is judged.

Figure 13:
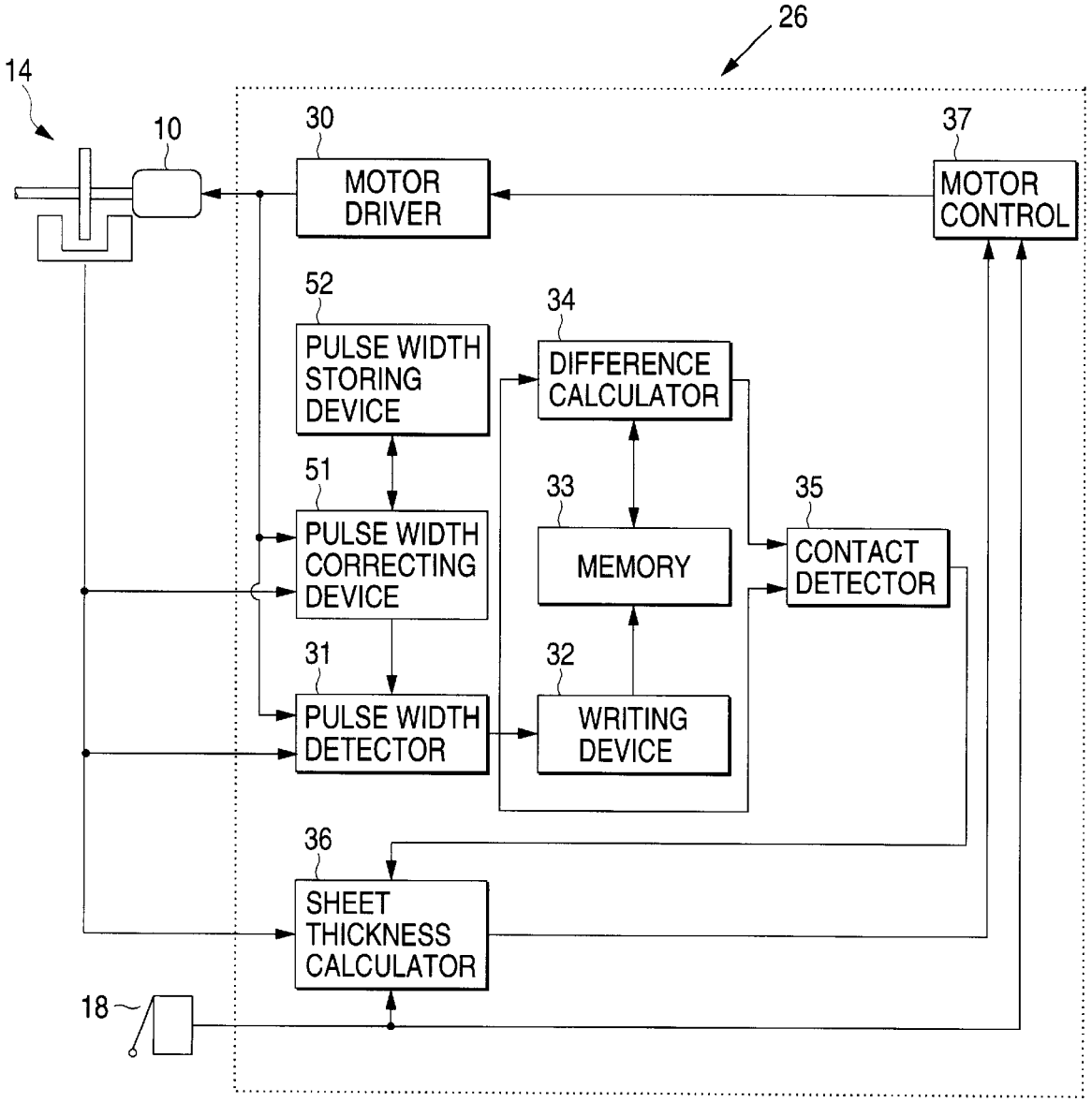
FIG. 13 illustrates another example of the present invention.

FIG. 13 illustrates an example to solve the above problems. Reference numeral 51 is a pulse width correcting device. When the contact position is detected or the platen gap is adjusted, the step motor 10 starts rotating and passes through an accelerating region and each pole of the rotor is moved to each pole of the stator. In this case, under the condition in which overshooting is not caused; that is, under the condition of running at a constant speed, the width of the pulse signal successively output from the encoder 14 is detected. The thus detected pulse width is made to correspond to the position of the code on the code disk of the encoder 14, or alternatively, the thus detected pulse width is made to correspond to each pole of the step motor 10, and the pulse width is stored in the pulse width storing device 52 as the pulse width data D1, D2, D3, ●●●, D47 and D48.

When the step motor 10 is rotated by an amount of revolutions corresponding to 48 poles, for example, each time a pulse signal, which is a detection signal, is output from the encoder 14, the corresponding pulse width data D1, D2, D3, ●●●, D47, D48 is read out from the pulse width storing means 51.

Figure 14:
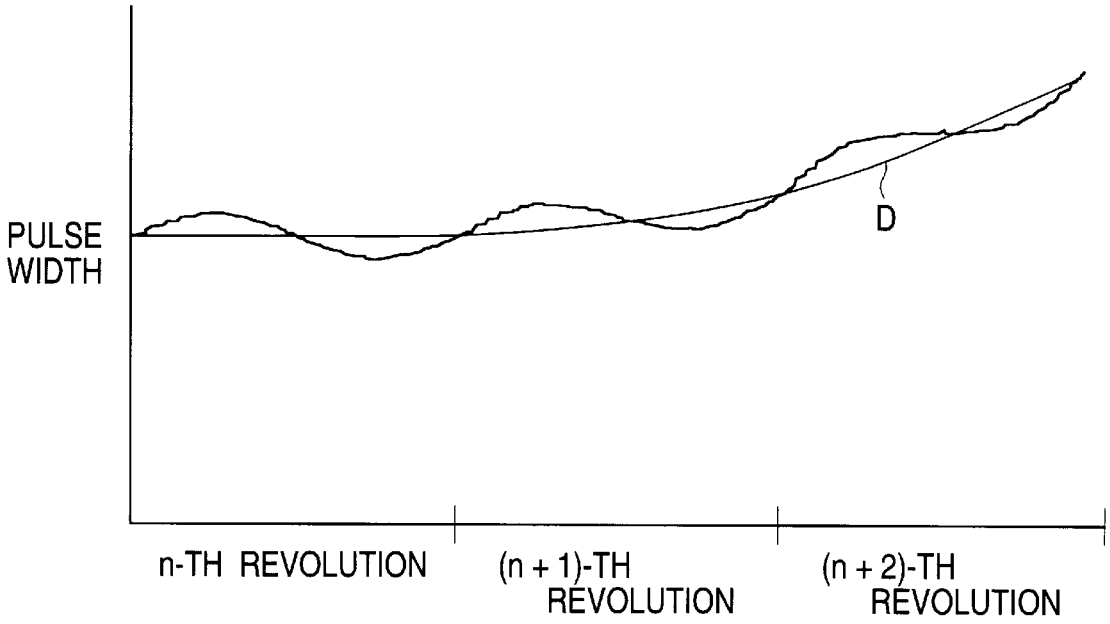
FIG. 14 is a graph showing a signal obtained when a change is removed from a signal of the encoder in the contact judgment processing.

In FIG. 13, reference numeral 52 is the pulse width storing device having addresses, the number of which is the same as the number of poles of the stepping motor 10 or the number of the codes on the code disk of the encoder 14. The pulse width storing device 52 is preferably composed in such a manner that the memory, corresponding to the number of the storing areas of which is the same as the number of poles of the step motor 10, can be read and written in circulation as illustrated in FIG. 14. In this connection, in the case of storing the pulse width data, when the differences D1-D0, D2-D0, D3-D0, ●●●D47-D0, D48-D0, which are obtained by subtracting the constant value D0 from the detected pulse width D1, D2, D3, ●●●D47, D48, are stored, it is possible to reduce the amount of data.

In this example, data is stored in the pulse width storing device 52 as follows. After the completion of determination of the reference position, a drive pulse signal is output to the step motor 10, so that the carriage 1 is made to proceed toward the platen 5. After the step motor 10 has been accelerated, the step motor is rotated at a constant speed. At this time, for example, when an amount of revolutions corresponding to 30 pulses has been completed, each time one drive pulse is output from the motor drive means 30, the pulse width correcting device 51 detects a signal sent from the encoder 14, and this data is stored in the pulse width storing device 52.

Figure 7:
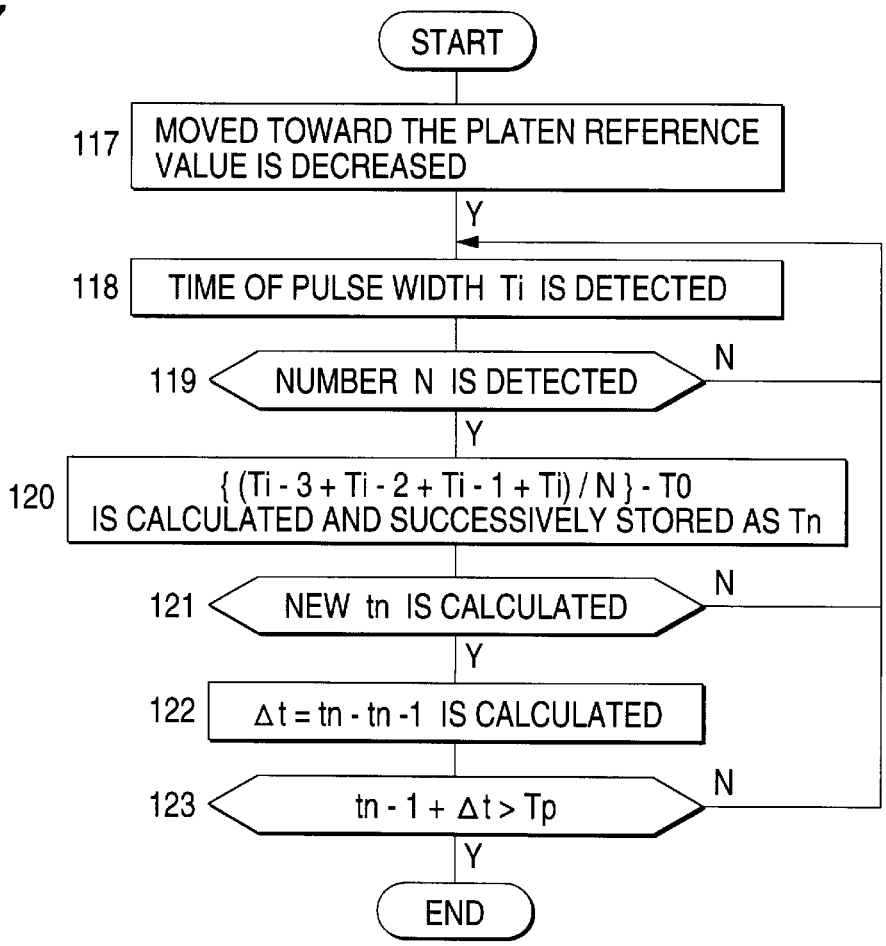
FIG. 7 is a flow chart showing a platen surface recognizing operation conducted in the above apparatus.

When the pulse width of the pulse signal corresponding to one revolution of the encoder 14 has been stored, passage error detection processing illustrated in FIG. 7 is carried out. The pulse width detector 31 detects the width of each pulse signal output from the encoder 14 while the width of each pulse signal is being corrected by the pulse width correcting device 51 in accordance with the pulse width D1, D2, D3, ●●●, D47, D48 stored in the pulse width storing device 52, or in accordance with the difference D1-D0, D2-D0, D3-D0, ●●●, D47-D0, D48-D0, wherein D0 is a constant value. When the correction is conducted as described above, after the completion of the n-th revolution, as shown by curve D in FIG. 14, it is possible to obtain a pulse width signal from which a surge caused by the fluctuating elements in the pulse motor 10 and encoder 14 is removed.

Figure 8:
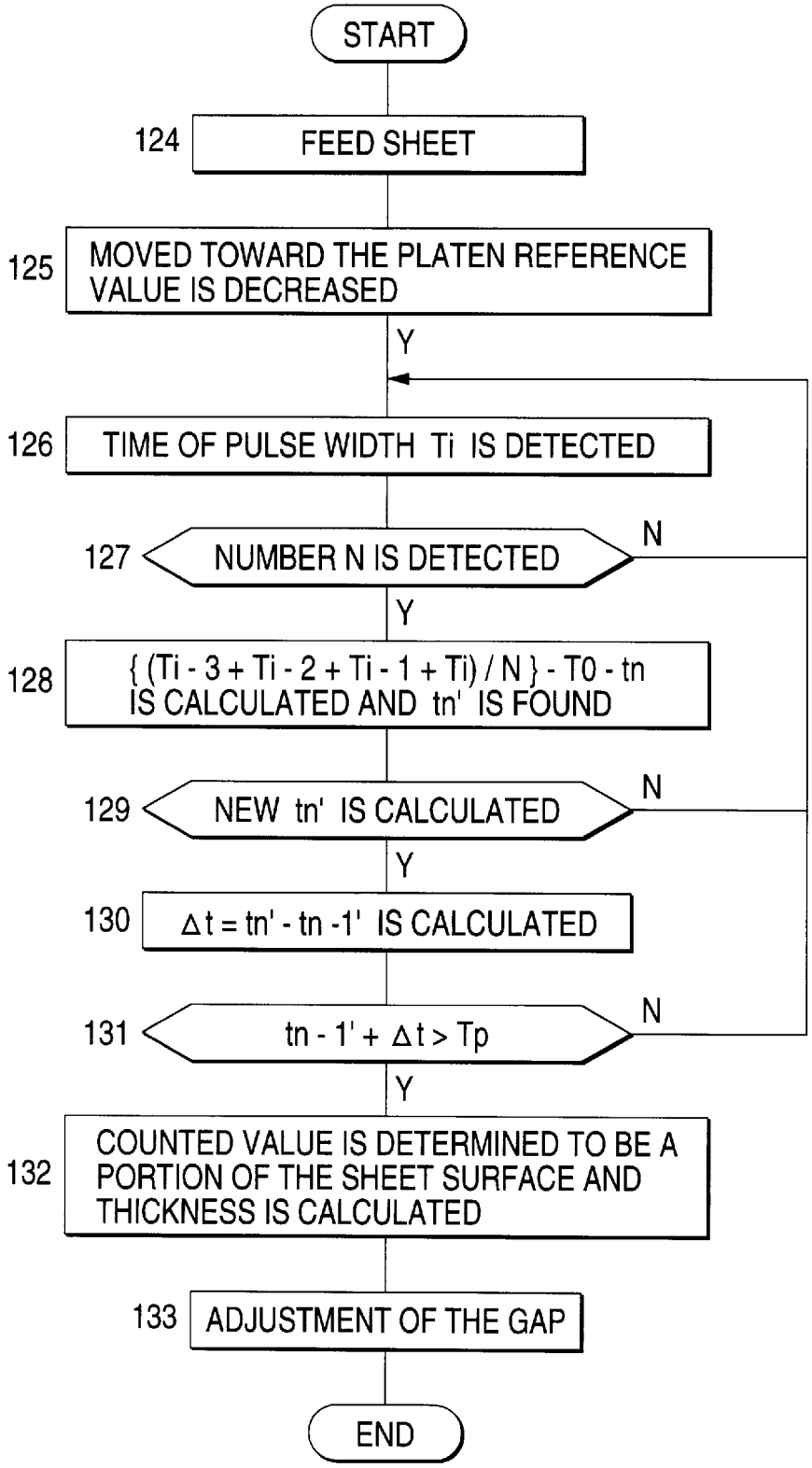
FIG. 8 is a flow chart showing a platen gap adjusting operation conducted in the above apparatus.

As described above, after the completion of the passage error detection processing, the platen gap adjustment processing shown in FIG. 8 is initiated. When the carriage 1 is moved into a region in which data is stored in the pulse width storing device 52, the pulse width detector 31 detects the width of each pulse signal output from the encoder 14 while the width of each pulse signal is being corrected by the pulse width correcting device 51 in accordance with the pulse width D1, D2, D3, ●●●, D47, D48 stored in the pulse width storing device 52, or in accordance with the difference D1-D0, D2-D0, D3 -D0, ●●●, D47-D0, D48-D0, wherein D0 is a constant value. When the pulse width of the signal sent from the encoder 14 reaches the contact judgment reference value, or when an integrated value of the difference between the pulse width of a pulse signal and the pulse width of a pulse signal immediately before the above pulse signal reaches the contact judgment reference value, it is judged to be a contact position.

Figure 15:
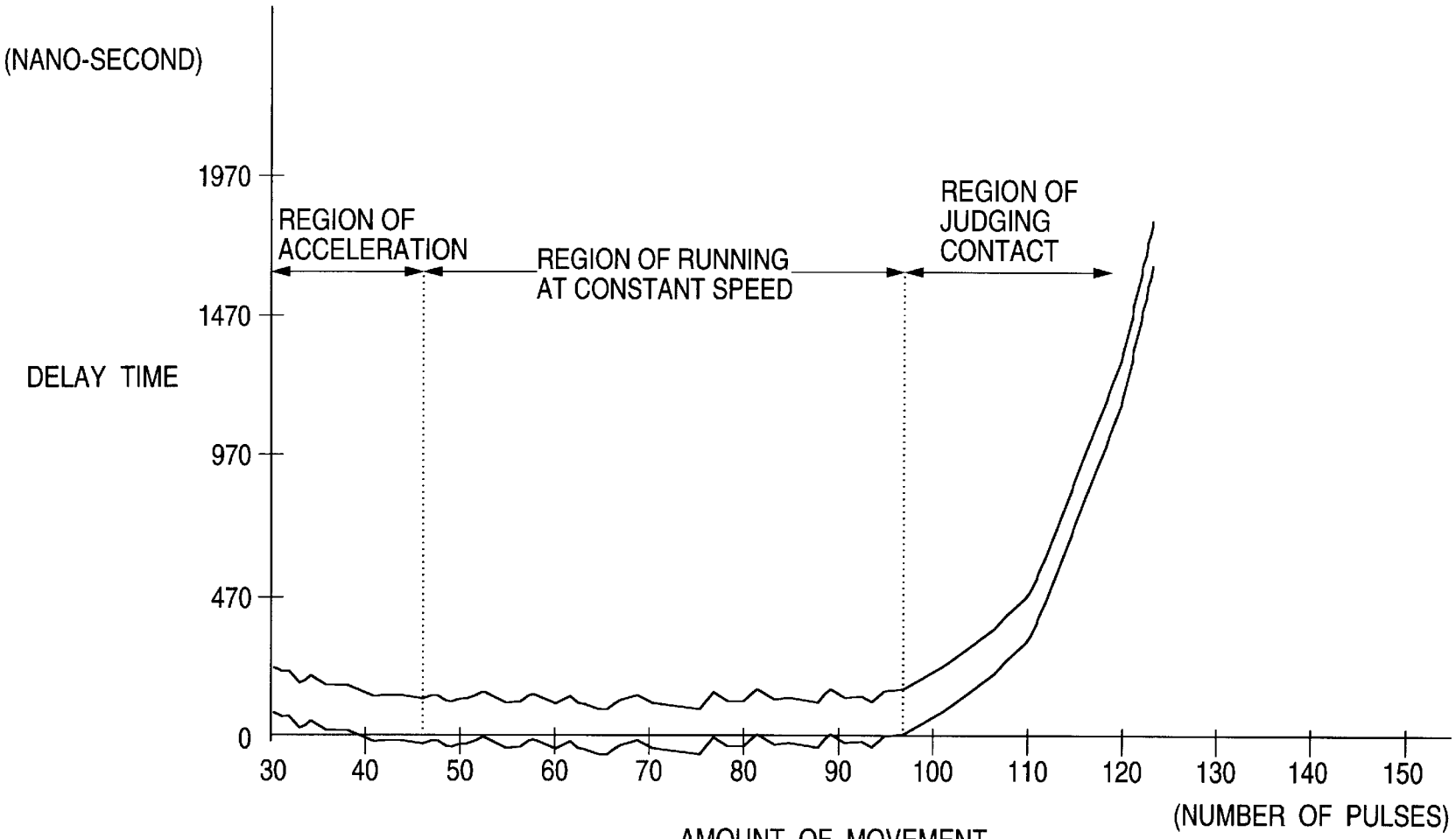
FIG. 15 is a graph showing the operation of the above apparatus.

Due to the foregoing, in the case of adjusting a platen gap, in the platen gap adjusting region as illustrated in FIG. 15, the rotational fluctuation of the step motor 10 and the fluctuation of the pulse width of the encoder 14 are removed, and only a change in the pulse width caused when a resistance of the moving passage is changed is expressed by a continuous line. Under the above condition, the contact point can be detected. Therefore, it is possible to eliminate errors caused by the aforementioned error factors of the step motor 10 and the encoder 14. Accordingly, the platen gap can be accurately set.

As explained above, an automatic adjusting device for adjusting a platen gap of the present invention comprises: a step motor for moving a carriage, on which a recording heads is mounted, in a direction perpendicular to a platen surface; a moving distance detector for outputting pulse signals of a constant pulse width, the number of which coincides with a moving distance of the carriage; a pulse width detector for detecting a pulse width of the pulse signal when the carriage is moved from a reference position in a direction of the platen; a storing device for storing reference data of the pulse width of the pulse signal corresponding to a position of the platen when the carriage is moved under the condition that the platen is not charged with a recording medium; a difference calculator for calculating a difference between a pulse width of the pulse signal sent from the pulse width detector when the carriage is moved under the condition that the platen is charged with a recording medium, and a pulse width of the pulse signal stored in the storing device, when the platen is located at a position concerned; a contact detector for judging a contact position of the recording head with the platen surface in accordance with a change in the difference; and a control device for controlling a relative gap between the carriage and the platen by a step motor so that the relative gap can be made to correspond to a thickness of the recording medium when the thickness of the recording medium is detected by a pulse signal of the pulse width detector in accordance with a distance from the reference position to the contact position judged by the contact detector. Accordingly, when the platen gap is adjusted, it is possible to remove a change in the pulse width caused when a resistance fluctuates in the movement of the carriage. Accordingly, it is possible to accurately detect a point of time at which the recording head comes into contact with the platen surface irrespective of a change with time, without soiling the recording medium and damaging the recording head.

What is claimed is:

1. An automatic platen gap adjusting device for adjusting a gap between a platen and a recording head of a printer, comprising:

a step motor for moving a carriage, on which said recording head is mounted, in a direction perpendicular to a platen surface;

moving distance detecting means for detecting drive signals output from said step motor and for outputting pulse signals, the number of which corresponding to a moving distance of said carriage;

pulse width detecting means for detecting a pulse width of a pulse signal when said carriage is moved from a reference position in a direction toward said platen surface;

a memory for storing a reference position of said carriage and reference pulse width data corresponding to movement of said carriage toward said platen surface when a recording medium is not positioned on said platen surface;

difference calculating means for calculating a difference between pulse width data output from said pulse width detecting means corresponding to movement of said carriage toward said platen surface when a recording medium is positioned on said platen surface, and said reference pulse width data and outputting a difference signal;

contact determining means for determining a contact position of said recording head with said platen surface when said difference signal is at least equal to a predetermined value; and control means for determining a thickness of said recording medium positioned on said platen based upon a difference between said contact position and said reference position, and for controlling said gap to correspond to said thickness of said recording medium.

2. The automatic gap adjusting device according to claim 1, wherein said pulse width detecting means is arranged to calculate an average value of pulse widths of said pulse signals and to output an average value signal.

3. The automatic gap adjusting device according to claim 1, further comprising:

position detecting means for detecting when said carriage is at said reference position; and sheet thickness calculating means for calculating said thickness of said recording medium by counting said pulse signals from said moving distance detecting means and decreasing a predetermined reference position value when each pulse signal is detected.

4. The automatic gap adjusting device according to claim 3, wherein said control means moves said carriage by a predetermined distance before beginning contact determining processing, and wherein said reference position is determined to be a position where a signal is output from said position detecting means.

5. An automatic platen gap adjusting device for adjusting a gap between a platen and a recording head of a printer, comprising:

a step motor for moving a carriage, on which said recording head is mounted, in a direction perpendicular to a platen surface;

moving distance detecting means for detecting drive signals output from said step motor and for outputting pulse signals, the number of which corresponding to a moving distance of said carriage;

pulse width detecting means for detecting a pulse width of a pulse signal when said carriage is moved from a reference position in a direction toward said platen surface;

a memory for storing a reference position of said carriage and reference pulse width data corresponding to movement of said carriage toward said platen surface when a recording medium is not positioned on said platen surface;

difference calculating means for calculating a difference between pulse width data output from said pulse width detecting means corresponding to movement of said carriage toward said platen surface when a recording medium is positioned on said platen surface, and said reference pulse width data and outputting a difference signal;

contact determining means for calculating an integrated value of said difference signal to generate an integrated signal, and for comparing said integrated signal with a predetermined value, wherein said contact position is detected when said integrated signal is at least equal to said predetermined value; and control means for determining a thickness of said recording medium positioned on said platen based upon a difference between said contact position and said reference position, and for controlling said gap to correspond to said thickness of said recording medium.

6. The automatic gap adjusting device according to claim 5, further comprising:

position detecting means for detecting when said carriage is at said reference position; and sheet thickness calculating means for calculating said thickness of said recording medium by counting said pulse signals from said moving distance detecting means and decreasing a predetermined reference position value when each pulse signal is detected.

7. The automatic gap adjusting device according to claim 6, wherein said control means moves said carriage by a predetermined distance before beginning contact determining processing, and wherein said reference position is determined to be a position where a signal is output from said position detecting means.

8. An automatic platen gap adjusting device for adjusting a gap between a platen and a recording head of a printer, comprising:

a step motor for moving a carriage, on which said recording head is mounted, in a direction perpendicular to a platen surface;

moving distance detecting means for detecting drive signals output from said step motor and for outputting pulse signals, the number of which corresponding to a moving distance of said carriage;

pulse width detecting means for detecting a pulse width of a pulse signal when said carriage is moved from a reference position in a direction toward said platen surface;

a memory for storing a reference position of said carriage and reference pulse width data corresponding to movement of said carriage toward said platen surface when a recording medium is not positioned on said platen surface;

difference calculating means for calculating a difference between pulse width data output from said pulse width detecting means corresponding to movement of said carriage toward said platen surface when a recording medium is positioned on said platen surface, and said reference pulse width data and outputting a difference signal;

contact determining means for determining a contact position based upon a point of inflection of a change in said difference signal; and control means for determining a thickness of said recording medium positioned on said platen based upon a difference between said contact position and said reference position, and for controlling said gap to correspond to said thickness of said recording medium.

9. The automatic gap adjusting device according to claim 8, further comprising:

position detecting means for detecting when said carriage is at said reference position; and sheet thickness calculating means for calculating said thickness of said recording medium by counting said pulse signals from said moving distance detecting means and decreasing a predetermined reference position value when each pulse signal is detected.

10. The automatic gap adjusting device according to claim 9, wherein said control means moves said carriage by a predetermined distance before beginning contact determining processing, and wherein said reference position is determined to be a position where a signal is output from said position detecting means.

11. An automatic platen gap adjusting device for adjusting a gap between a platen and a recording head of a printer, comprising:

a step motor for moving a carriage, on which said recording head is mounted, in a direction perpendicular to a platen surface;

moving distance detecting means for detecting drive signals output from said step motor and for outputting pulse signals, the number of which corresponding to a moving distance of said carriage;

pulse width detecting means for detecting a pulse width of a pulse signal when said carriage is moved from a reference position in a direction toward said platen surface;

a memory for storing a position determination function and a reference position of said carriage;

means for receiving pulse widths of said pulse signals at a plurality of points output from said moving distance detecting means and for determining corrected time delay data at said points, respectively, based upon a relative position of said carriage with respect to said reference position according to said position determination function stored in said memory;

difference calculating means for calculating a difference between time delay data output from said pulse width detecting means and said corrected time delay data and for outputting a difference signal;

contact determining means for determining a contact position of said recording head with said platen surface when said difference signal is at least equal to a predetermined value; and control means for determining a thickness of said recording medium positioned on said platen based upon a difference between said contact position and said reference position, and for controlling said gap to correspond to said thickness of said recording medium.

12. The automatic gap adjusting device according to claim 11, further comprising:

position detecting means for detecting when said carriage is at said reference position; and sheet thickness calculating means for calculating said thickness of said recording medium by counting said pulse signals from said moving distance detecting means and decreasing a predetermined reference position value when each pulse signal is detected.

13. The automatic gap adjusting device according to claim 12, wherein said control means moves said carriage by a predetermined distance before beginning contact determining processing, and wherein said reference position is determined to be a position where a signal is output from said position detecting means.

14. An automatic platen gap adjusting device for adjusting a gap between a platen and a recording head of a printer, comprising:

a step motor for moving a carriage, on which said recording head is mounted, in a direction perpendicular to a platen surface;

moving distance detecting means for detecting drive signals output from said step motor and for outputting pulse signals, the number of which corresponding to a moving distance of said carriage;

pulse width detecting means for detecting a pulse width of a pulse signal when said carriage is moved from a reference position in a direction toward said platen surface;

a memory for storing a position determination function and a reference position of said carriage;

means for receiving pulse widths of said pulse signals at a plurality of points output from said moving distance detecting means and for determining corrected time delay data at said points, respectively, based upon a relative position of said carriage with respect to said reference position according to said position determination function stored in said memory;

difference calculating means for calculating a difference between time delay data output from said pulse width detecting means and said corrected time delay data and for outputting a difference signal;

contact determining means for determining a contact position of said recording head with said platen surface when said difference signal is at least equal to a predetermined value; and control means for determining a thickness of said recording medium positioned on said platen based upon a difference between said contact position and said reference position, and for controlling said gap to correspond to said thickness of said recording medium.

15. The automatic gap adjusting device according to claim 14, further comprising:

position detecting means for detecting when said carriage is at said reference position; and sheet thickness calculating means for calculating said thickness of said recording medium by counting said pulse signals from said moving distance detecting means and decreasing a predetermined reference position value when each pulse signal is detected.

16. The automatic gap adjusting device according to claim 15, wherein said control means moves said carriage by a predetermined distance before beginning contact determining processing, and wherein said reference position is determined to be a position where a signal is output from said position detecting means.

17. An automatic platen gap adjusting device for adjusting a gap between a platen and a recording head of a printer, comprising:

a step motor for moving a carriage, on which said recording head is mounted, in a direction perpendicular to a platen surface;

moving distance detecting means for detecting drive signals output from said step motor and for outputting pulse signals, the number of which corresponding to a moving distance of said carriage;

pulse width detecting means for detecting a pulse width of a pulse signal when said carriage is moved from a reference position in a direction toward said platen surface, receiving corrected pulse signals, and outputting pulse width data;

pulse width correcting means for storing pulse widths of a pulse signals corresponding to one revolution of said step motor successively output from said moving distance detecting means when said step motor drives said carriage at a constant speed wherein stored pulse widths represent correction data, for successively correcting said pulse signals output from said moving distance detecting means in accordance with said correction data, and outputting said corrected pulse signals to said pulse width detecting means;

a memory for storing a reference position of said carriage and reference pulse width data corresponding to movement of said carriage toward said platen surface when a recording medium is not positioned on said platen surface;

difference calculating means for calculating a difference between pulse width data output from said pulse width detecting means corresponding to movement of said carriage toward said platen surface when a recording medium is positioned on said platen surface, and said reference pulse width data and outputting a difference signal;

contact determining means for determining a contact position of said recording head with said platen surface in accordance with said difference signal; and control means for determining a thickness of said recording medium positioned on said platen, and for controlling said gap to correspond to said thickness of said recording medium.

18. The automatic gap adjusting device according to claim 17, further comprising:

position detecting means for detecting when said carriage is at said reference position; and sheet thickness calculating means for calculating said thickness of said recording medium by counting said pulse signals from said moving distance detecting means and decreasing a predetermined reference position value when each pulse signal is detected.

19. The automatic gap adjusting device according to claim 18, wherein said control means moves said carriage by a predetermined distance before beginning contact determining processing, and wherein said reference position is determined to be a position where a signal is output from said position detecting means.

20. A method for automatically adjusting a platen gap between a platen and a recording head of a printer, comprising the steps of:

moving a carriage, on which said recording head is mounted, in a direction perpendicular to a platen surface;

detecting drive signals output from a step motor;

outputting pulse signals, the number of which corresponding to a moving distance of said carriage;

detecting a pulse width of a pulse signal when said carriage is moved from a reference position in a direction toward said platen surface;

storing a reference position of said carriage and reference pulse width data corresponding to movement of said carriage toward said platen surface when a recording medium is not positioned on said platen surface;

calculating a difference between pulse width data output from a pulse width detecting means corresponding to movement of said carriage toward said platen surface when a recording medium is positioned on said platen surface, and said reference pulse width data to determine a difference signal;

determining a contact position of said recording head with said platen surface when said difference signal is at least equal to a predetermined value;

determining a thickness of said recording medium positioned on said platen based upon a difference between said contact position and said reference position; and controlling said gap to correspond to said thickness of said recording medium.

21. A method for automatically adjusting a platen gap between a platen and a recording head of a printer, comprising the steps of:

moving a carriage, on which said recording head is mounted, in a direction perpendicular to a platen surface;

detecting drive signals output from a step motor;

outputting pulse signals, the number of which corresponding to a moving distance of said carriage;

detecting a pulse width of a pulse signal when said carriage is moved from a reference position in a direction toward said platen surface;

storing a reference position of said carriage and reference pulse width data corresponding to movement of said carriage toward said platen surface when a recording medium is not positioned on said platen surface;

calculating a difference between pulse width data output from a pulse width detecting means corresponding to movement of said carriage toward said platen surface when a recording medium is positioned on said platen surface, and said reference pulse width data to determine a difference signal;

calculating an integrated value of said difference signal to generate an integrated signal;

comparing said integrated signal with a predetermined value, wherein said contact position is detected when said integrated signal is at least equal to said predetermined value;

determining a thickness of said recording medium positioned on said platen based upon a difference between said contact position and said reference position; and controlling said gap to correspond to said thickness of said recording medium.

22. A method for automatically adjusting a platen gap between a platen and a recording head of a printer, comprising the steps of:

moving a carriage, on which said recording head is mounted, in a direction perpendicular to a platen surface;

detecting drive signals output from a step motor;

outputting pulse signals, the number of which corresponding to a moving distance of said carriage;

detecting a pulse width of a pulse signal when said carriage is moved from a reference position in a direction toward said platen surface;

storing a reference position of said carriage and reference pulse width data corresponding to movement of said carriage toward said platen surface when a recording medium is not positioned on said platen surface;

calculating a difference between pulse width data output from a pulse width detecting means corresponding to movement of said carriage toward said platen surface when a recording medium is positioned on said platen surface, and said reference pulse width data to determine a difference signal;

determining a contact position based upon a point of inflection of a change in said difference signal;

determining a thickness of said recording medium positioned on said platen based upon a difference between said contact position and said reference position; and controlling said gap to correspond to said thickness of said recording medium.

23. A method for automatically adjusting a platen gap between a platen and a recording head of a printer, comprising the steps of:

moving a carriage, on which said recording head is mounted, in a direction perpendicular to a platen surface;

detecting drive signals output from a step motor;

outputting pulse signals, the number of which corresponding to a moving distance of said carriage;

detecting a pulse width of a pulse signal when said carriage is moved from a reference position in a direction toward said platen surface;

storing a position determination function and a reference position of said carriage;

receiving pulse widths of said pulse signals at a plurality of points output from a moving distance detecting means;

determining corrected time delay data at said points, respectively, based upon a relative position of said carriage with respect to said reference position according to said position determination function stored in a memory;

calculating a difference between time delay data output from a pulse width detecting means and said corrected time delay data to determine a difference signal;

determining a contact position of said recording head with said platen surface when said difference signal is at least equal to a predetermined value;

determining a thickness of said recording medium positioned on said platen based upon a difference between said contact position and said reference position; and controlling said gap to correspond to said thickness of said recording medium.

24. A method for automatically adjusting a platen gap between a platen and a recording head of a printer, comprising the steps of:

moving a carriage, on which said recording head is mounted, in a direction perpendicular to a platen surface;

detecting drive signals output from a step motor;

outputting pulse signals, the number of which corresponding to a moving distance of said carriage;

detecting a pulse width of a pulse signal when said carriage is moved from a reference position in a direction toward said platen surface;

storing a position determination function and a reference position of said carriage;

receiving pulse widths of said pulse signals at a plurality of points output from a moving distance detecting means;

determining corrected time delay data at said points, respectively, based upon a relative position of said carriage with respect to said reference position according to said position determination function stored;

calculating a difference between time delay data output from a pulse width detecting means and said corrected time delay data to determine a difference signal;

determining a contact position of said recording head with said platen surface when said difference signal is at least equal to a predetermined value;

determining a thickness of said recording medium positioned on said platen based upon a difference between said contact position and said reference position; and controlling said gap to correspond to said thickness of said recording medium.

25. A method for automatically adjusting a platen gap between a platen and a recording head of a printer, comprising the steps of:

moving a carriage, on which said recording head is mounted, in a direction perpendicular to a platen surface;

detecting drive signals output from a step motor;

outputting pulse signals, the number of which corresponding to a moving distance of said carriage;

detecting a pulse width of a pulse signal when said carriage is moved from a reference position in a direction toward said platen surface;

receiving corrected pulse signals;

outputting pulse width data;

storing pulse widths of a pulse signals corresponding to one revolution of said step motor successively output from a moving distance detecting means when said step motor drives said carriage at a constant speed wherein stored pulse widths represent correction data;

successively correcting said pulse signals output from said moving distance detecting means in accordance with said correction data;

outputting said corrected pulse signals to said pulse width detecting means;

storing a reference position of said carriage and reference pulse width data corresponding to movement of said carriage toward said platen surface when a recording medium is not positioned on said platen surface;

calculating a difference between pulse width data output from a pulse width detecting means corresponding to movement of said carriage toward said platen surface when a recording medium is positioned on said platen surface, and said reference pulse width data to determine a difference signal;

determining a contact position of said recording head with said platen surface in accordance with said difference signal;

determining a thickness of said recording medium positioned on said platen; and controlling said gap to correspond to said thickness of said recording medium.

* * * * *